US007320154B2

(12) United States Patent
Leger

(10) Patent No.: US 7,320,154 B2
(45) **Date of Patent: *Jan. 22, 2008**

(54) FLEECE LAYING DEVICE

(75) Inventor: Joachim Leger, Eberbach (DE)

(73) Assignee: Oskar Dilo Maschinenfabrik AG (DE)

( * ) Notice: Subject to any disclaimer, the term of this patent is extended or adjusted under 35 U.S.C. 154(b) by 348 days.

This patent is subject to a terminal disclaimer.

(21) Appl. No.: 11/074,891

(22) Filed: Mar. 8, 2005

(65) Prior Publication Data

US 2005/0193525 A1 Sep. 8, 2005

(30) Foreign Application Priority Data

Mar. 8, 2004 (EP) ..... 04005460
Apr. 2, 2004 (EP) ..... 04008051
Jul. 1, 2004 (EP) ..... 04015488

(51) Int. Cl.
*D01G 25/00* (2006.01)

(52) U.S. Cl. ..... 19/296; 19/161.1

(58) Field of Classification Search ..... 19/161.1–163, 19/296; 270/32, 39.05, 40, 41
See application file for complete search history.

(56) References Cited

U.S. PATENT DOCUMENTS 2,962,772 A * 12/1960 Draving et al. ..... 19/163
3,222,730 A 12/1965 Kalwaites
4,984,772 A * 1/1991 Freund ..... 270/30.01
5,007,623 A 4/1991 Unkuri et al.
5,590,442 A 1/1997 Hirschek et al.
RE35,982 E * 12/1998 Freund ..... 191/63
6,662,407 B2 * 12/2003 Bernhardt et al. ..... 19/161.1
2005/0193525 A1 * 9/2005 Leger ..... 19/63
2005/0193526 A1 * 9/2005 Leger ..... 19/163
2005/0217077 A1 * 10/2005 Bastian et al. ..... 19/161.1

FOREIGN PATENT DOCUMENTS

FR 2846342 A1 4/2004

* cited by examiner

*Primary Examiner*—Shaun R. Hurley
(74) *Attorney, Agent, or Firm*—Jansson Shupe & Munger Ltd.

(57) ABSTRACT

A non-woven fiber web laying apparatus including (1) a camel back cross lapper having a supply arm, a laying arm connected thereto, and two delivery transport belts guided in juxtaposed fashion from an infeed zone to a lower end of the layering arm and (2) an upstream web buffering apparatus adapted to hold a web between belts at least one of which is one of the two delivery transport belts, the apparatus sandwiching the fiber web substantially the entire path from the take-up site to the laying-arm lower end.

14 Claims, 5 Drawing Sheets

FLEECE LAYING DEVICE

RELATED APPLICATIONS

This application claims the benefit of: EP 04 005 460.3, filed on Mar. 8, 2004; EP 04 008 051.7, filed on Apr. 2, 2004; and EP 04 015 488.2, filed Jul. 1, 2004. The contents of these applications are incorporated herein.

FIELD OF THE INVENTION

This invention is related to the field of producing non-woven fabric or fleece made from fiber material. More particularly, the invention relates to machinery known as a cross lapper.

BACKGROUND OF THE INVENTION

U.S. Pat. No. 5,590,442 describes equipment for producing non-woven fabric, or fleece, made of fiber material. In this known fleece laying equipment, the cross lapper is a so-called flat cross lapper having an upper carriage and a laying carriage, each of which is provided with deflection rolls over which first and second endless transport belts conveying a non-woven fiber web are passed. These transport belts define a path length between the carriages. Within the path length, the fiber web is contacted on both sides by the transport belts. In the web path running to the upper carriage, the fiber web lies loosely on the first transport belt, and even at the roll supported at the upper carriage and deflecting said first transport belt the fiber web is not covered by any protection means. In the region between the upper carriage and the laying carriage, the fiber web passes two locations at which it is supported only on one side, namely, by the second transport belt.

In this known equipment, the web buffering device located upstream of the cross lapper is a separate unit which is able to buffer a variable length of fiber web, i.e., a variable volume, and to supply the cross lapper in a timely controlled manner with more or less fiber web, since during operation, the transport belts have varying running speeds caused by the laying movements of the moving carriages in the cross lapper. The fiber web buffering device comprises a mounting frame in which two deflection rolls are mounted separated from and in parallel to one another. An endless pressure belt is passed over both deflection rolls. The mounting frame is located in the running path section of the upper section of an endless feeding belt extending between a carding machine supplying the fiber web and the cross lapper, so that a U-shaped path deviation portion is formed in this path section. The length of this U-shaped path deviation portion is dependent how far the mounting frame penetrates into the otherwise straight running path of the feeding belt. To compensate the length of the feeding belt, a returning lower section of the feeding belt is passed by a carriage on which are mounted two deflection rolls. The carriage moves in opposite direction with respect to the movement of the mounting frame.

In the region of the transfer of the fiber web from the web buffering device to the cross lapper, there is a triangle-like gap between a deflection roll of the feeding belt running through the web buffering device and a deflection roll of the first transport belt of the cross lapper. This triangle-like gap must be passed by the fiber web on its path from the web buffering device to the cross lapper. The fiber web is not supported in this part of its path. Thus a drawing movement may distort a sensitive fiber web within this unsupported region. Following this region, the fiber web is lying loosely on the first transport belt of the cross lapper. Because of this, the web material may flutter on the transport belt when the conveying speed is high, also causing a reduction in web quality.

OBJECTS OF THE INVENTION

It is an object of the invention to provide improved fleece laying apparatus which overcomes some of the problems and shortcomings of the prior art, including those referred to above.

Another object of the invention to provide fleece laying apparatus which is able to process the fiber web to be layered in a very careful manner on its whole transport path, extending from the take-up zone of the web buffering device to the laying onto an output conveyor of the cross lapper.

Another object of the invention is to provide fleece laying apparatus which produces high quality fleece material by reducing distortions in the web material during processing.

How these and other objects are accomplished will become apparent from the following descriptions and the drawings.

SUMMARY OF THE INVENTION

This invention is an improved fleece laying apparatus of the type including a camel back cross lapper and variable-volume web buffering apparatus upstream thereof.

The cross lapper includes (a) an infeed zone, (b) an output conveyor, (c) a supply arm, (d) a laying arm with a lower end reciprocatingly guided on a path above the output conveyor and transverse to an output direction of the output conveyor, and (e) two delivery transport belts guided in juxtaposed fashion from the infeed zone to the laying-arm lower end. The web buffering apparatus, which is upstream of the infeed zone, is adapted to hold a web between two take-up transport belts at least one of which is one of the two delivery transport belts. The web buffering apparatus includes a movable common frame and frame rollers rotatably mounted on the common frame, the frame rollers including a two-belt roller deflecting the take-up transport belts by about 180°, and at least two one-belt rollers, the common frame being movable transverse the roller axes. At least one of the one-belt rollers is wrapped by the one delivery transport belt (i.e., the take-up transport belt which is also a delivery transport belt—sometime referred to herein as the delivery/take-up transport belt), such belt being guided through an upstream web take-up site to the infeed zone, such that the web is sandwiched between paired belts along substantially the entire path from the take-up site to the output conveyor.

A preferred embodiment also has: a triplet of stationary rollers including two lateral triplet rollers close to the common frame and an intermediate triplet roller between the lateral rollers; a fourth stationary roller closely opposing the intermediate triplet roller and partially wrapped by the other of the two delivery transport belts; and a fifth stationary roller. The common frame is movable within a plane defined by axes of the frame rollers. While one of the take-up transport belts is a delivery transport belt, the other is a pressure belt adjacent to the fifth stationary roller, the pressure belt passing over two of the frame rollers adjacently mounted on the common frame and wrapping the two lateral triplet rollers by about 90° and the intermediate triplet roller by about 180°. The portion of the delivery/take-up transport belt that returns from the supply arm passes over another of the one-belt rollers on the common frame, wrapping such one-belt roller by about 180°, passing to the take-up site and downstream over the fifth stationary roller. Such delivery/take-up belt is guided from the take-up site in a manner juxtaposed with the pressure belt to wrap the two-belt roller by about 180°, then to wrap one of the lateral triplet rollers by about 90°, and from there past the intermediate triplet roller to the fourth stationary roller, there joining the other of the two delivery transport belts running to the supply arm.

In such embodiments, it is preferred that the intermediate triplet roller be a driven roll. The apparatus includes a drive system, the drive system being coupled to move the common frame.

Preferred embodiments include two tensioning rollers each wrapped by about 180° by a respective one of the two delivery transport belts, and tension sources moving the tensioning rollers.

In certain preferred embodiments, the juxtaposed delivery transport belts between the infeed zone and the layering-arm lower end are jointly guided along the supply and laying arms via a plurality of guiding rollers disposed seriatim along the arms, adjacent guiding rollers engaging opposite sides of the juxtaposed belts.

In certain embodiments of the invention, both of the two take-up transport belts are the two delivery transport belts.

In certain of such embodiments, the delivery transport belts run in juxtaposed fashion from a U-shaped feed path portion around the two-belt frame roller of the web buffering apparatus all the way to the laying-arm lower end. Separate portions of the delivery transport belts return from the laying-arm lower end to the take-up site through U-shaped return path portions each around a respective one of the one-belt frame rollers, each of such U-shaped return path portions being oriented opposite to the U-shaped feed path portion. The common frame which carries the three frame rollers is movably mounted in a machine stand, movable substantially parallel to the path portions extending to and from the frame deflecting rollers, thereby varying the buffering volume of the web buffering apparatus. It is preferred that the common frame be pivotably supported around the axis of the two-belt frame roller.

In certain embodiments, the common frame is movably held by a pendulum. Other forms of common frame movement, such as translation by use of a movable carriage, are possible.

Certain preferred embodiments include a tensioning roller movably mounted to the machine stand, the delivery transport belt from one of the U-shaped return path portions substantially half-wrapping the tensioning roller, the tensioning roller being biased away from the U-shape of such return path portion.

Some preferred embodiments include first and second independent drive rollers and a common drive roller, wherein the separate portions of the delivery transport belts are each guided over a respective one of the independent drive rollers and the juxtaposed portions of the delivery transport belts are commonly guided over the common drive roller. The common drive roller is driven at a circumferential speed that is variable with respect to the circumferential speeds of the first and second independent drive rollers, and the discharge speed of the apparatus is varied with respect to the take-up speed of the apparatus.

In some preferred embodiments, the two-belt frame roller is also a driven roller. The two-belt frame roller is driven at a circumferential speed that is variable with respect to the circumferential speeds of the first and second independent drive rollers, such that the discharge speed of the apparatus is varied with respect to the take-up speed of the apparatus.

The drawings show the essential features of the invention, and this in schematic views only, since schematics are sufficient for an understanding of the invention.

DETAILED DESCRIPTION OF PREFERRED EMBODIMENTS

Figure 1:
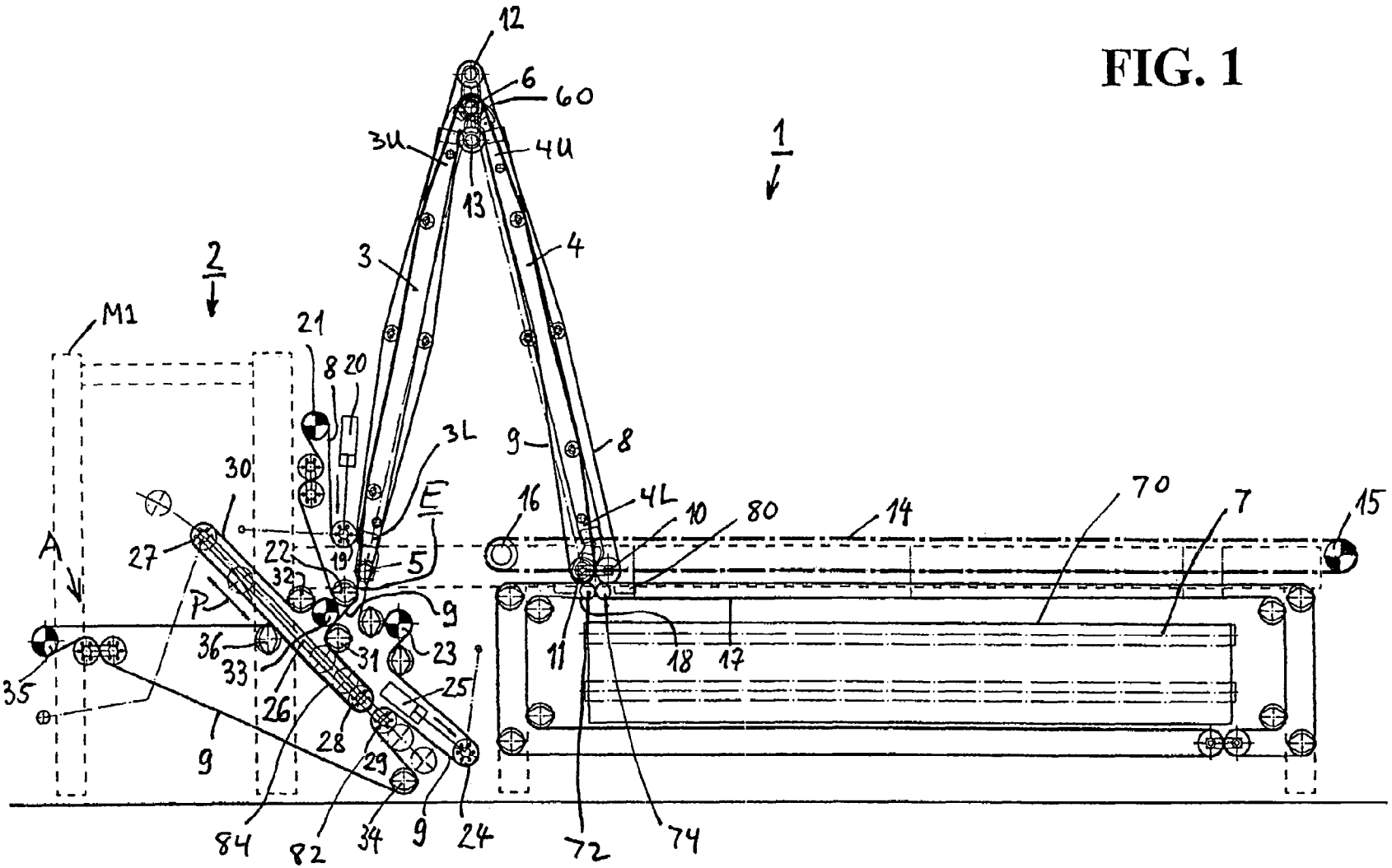
FIGS. 1 and 2 are schematic views showing a first embodiment of the invention in two different positions of the arms of a cross lapper of the camel back type, including a longitudinally movable common frame within a web buffering apparatus.
Figure 1A:
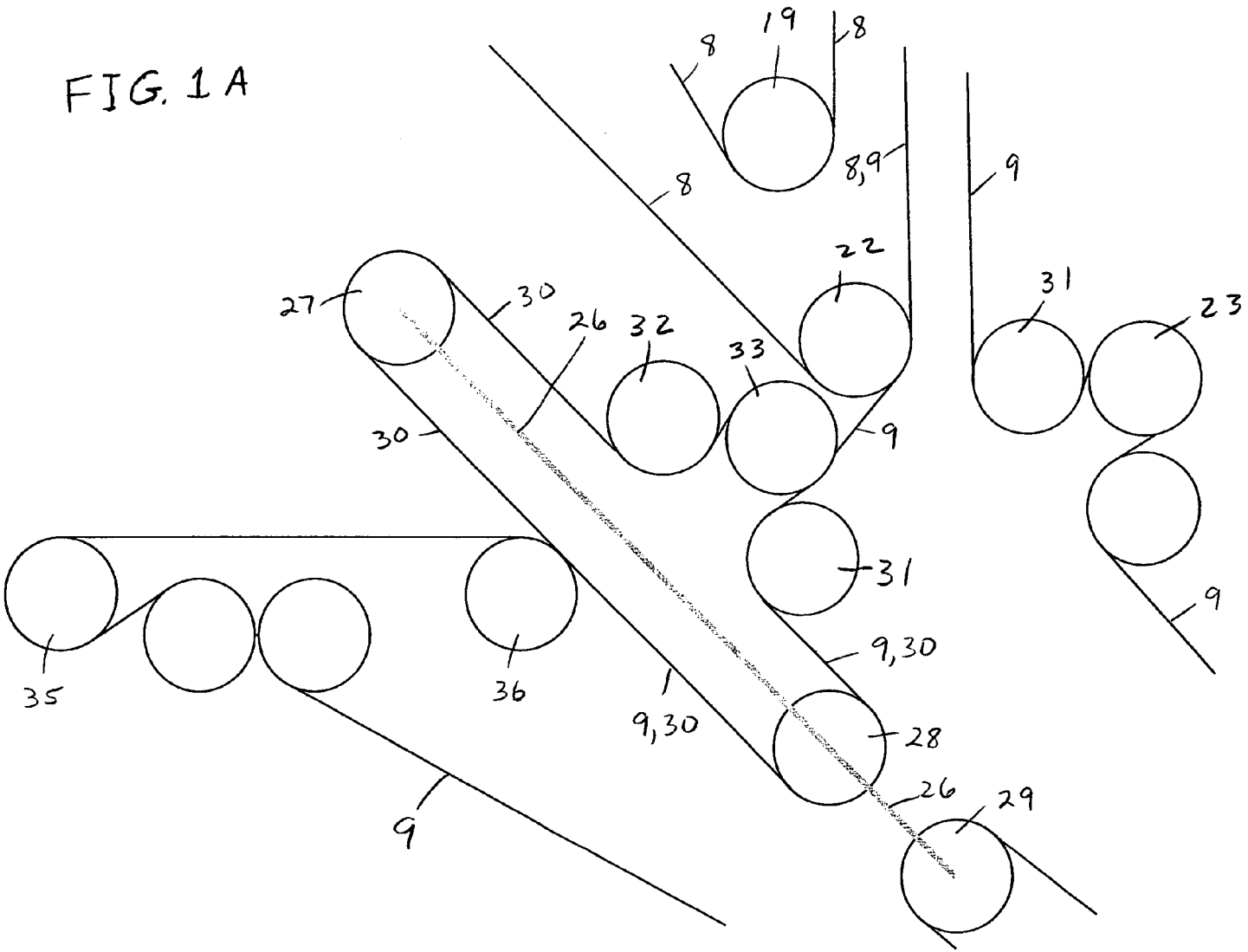
FIG. 1A is an enlarged fragmentary schematic view of a portion of the web buffering apparatus to facilitate understanding of the belt paths within the web buffering apparatus.
Figure 2:
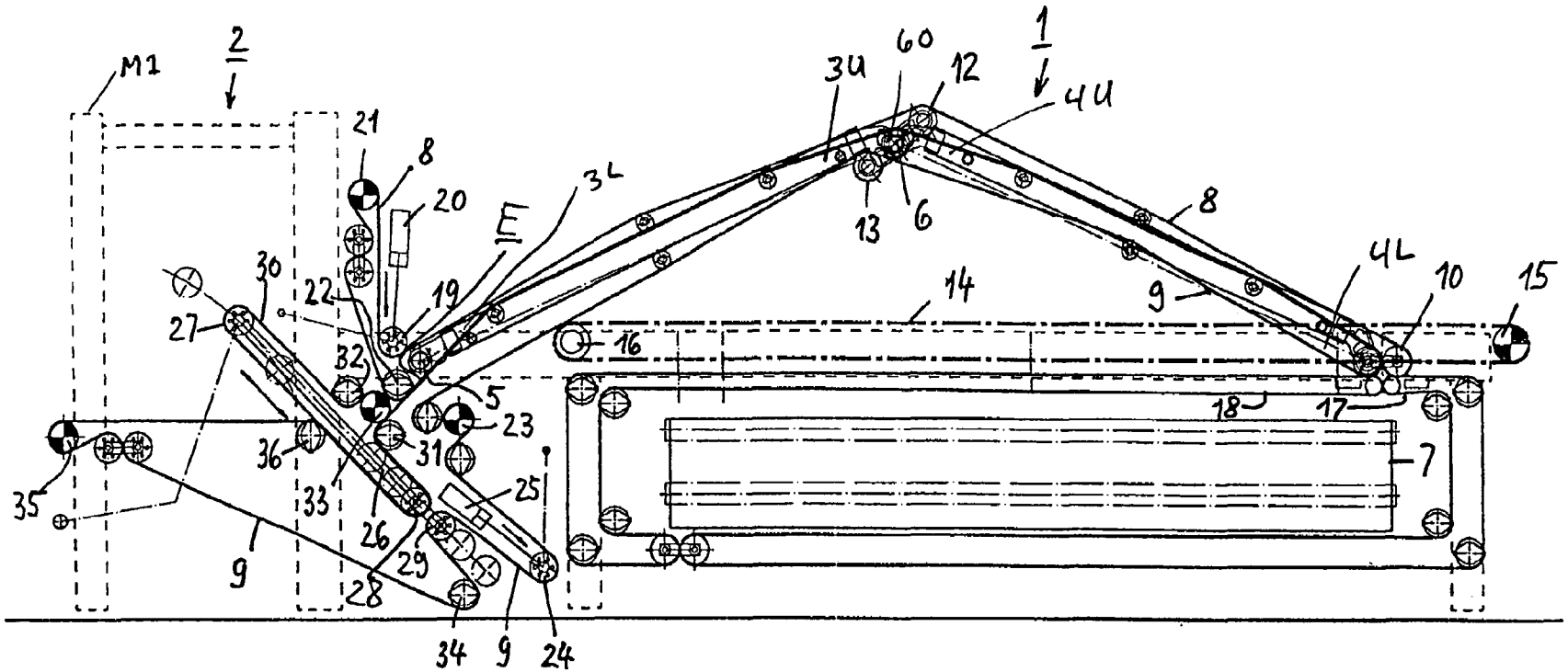

In the embodiment illustrated in FIGS. 1, 1A and 2, the inventive apparatus includes a cross lapper 1 of the camel back type and associated fiber web buffering apparatus 2 disposed upstream of an infeed zone E of cross lapper 1. Camel back cross lapper 1 comprises a supply arm 3 and a laying arm 4 which are pivotably connected to one another. Supply arm 3 is pivotably supported at its lower end 3L at a lower pivot axis 5. Supply arm 3 is pivotably connected at its upper end 3U to laying arm 4 by an upper hinge 6. Laying arm 4 extends downwardly and has a free end (lower end 4L) which is guided on a straight movement path horizontally above an output conveyor 7 of cross lapper 1. As shown in FIGS. 1, 1 A and 2, output conveyor 7 is formed by an endless belt 70 constantly driven in an output direction extending transversely to the direction of the movement path of laying arm 4.

Two transport belts, namely, an upper transport belt 8 and a lower transport belt 9, are passed over supply arm 3 and laying arm 4. In the sections of these belts which run to lower end 4L of laying arm 4, transport belts 8 and 9 are guided in parallel to one another via both arms 3 and 4 so that a non-woven fiber web (not shown) supplied between transport belts 8 and 9 is covered and supported by belts 8 and 9 from both sides; thus careful processing of the fiber web is achieved.

On the axis of hinge 6 in which both arms 3 and 4 of cross lapper 1 are connected to one another, a deflecting roller 60 is rotatably mounted, and both transport belts 8 and 9 pass over deflecting roller 60. (The apparatus shown in FIGS. 1-4 contain numerous deflecting and drive rollers which will be specified primarily by reference number only and not by differentiating names.) At lower end 4L of laying arm 4, transport belts 8 and 9 separate from one another via separate deflecting rollers 10 and 11. At this point, belts 8 and 9 return via laying arm 4 and supply arm 3. Belts 8 and 9 are passed over an upper and a lower deflecting roller 12 and 13, respectively, both of which are rotatably mounted within a holding frame (not explicitly shown) mounted at hinge 6.

Lower end 4L of laying arm 4 is connected to a carriage 80 which is movably guided on rails (not shown) horizontally above output conveyor 7. Carriage 80 is connected to a driving system which includes toothed driving wheel 15, via a toothed belt 14 and a deflection sprocket 16. At carriage 80, two deflecting rollers 72 and 74 are mounted over which covering belts 17 and 18, respectively, are passed by means of which the fleece formed on output conveyor 7 is covered to avoid any distortion by aerodynamic effects caused by the operation of the apparatus.

The portion of first transport belt 8 returning from supply arm 3 passes over a tensioning roller 19 which is looped by this belt portion by about 180°. Tensioning roller 19 is biased by a hydraulic or pneumatic tensioning cylinder 20. As transport belt 8 leaves tensioning roller 19, it is guided by a stationarily mounted, driven deflecting roller 21 and a stationarily mounted deflecting roller 22, and then passes back to supply arm 3 to form a feeding section of the transport belt.

The section of transport belt 9 returning from supply arm 3 is guided by a driven deflecting roller 23 and a tensioning roller 24. Tensioning roller 24 is looped by belt 9 by about 180° and is under the biasing influence of a hydraulic or pneumatic tensioning cylinder 25, at which point belt 9 runs toward web buffering apparatus 2.

Web buffering apparatus 2 has a mounting frame 26, in which three deflecting rollers 27, 28 and 29 are rotatably mounted in parallel to one another in a common plane. Mounting frame 26 is movable within the plane defined by the axes of its deflecting rollers 27 to 29 transverse to the axial direction of deflecting rollers 27 to 29 within a machine stand M1, shown in the drawing by phantom lines. The direction of movement of mounting frame 26 is shown by the double arrow P. A pressure belt 30 is guided by deflecting rollers 27 and 28. Further, pressure belt 30 is guided through a roller triplet comprising two lateral deflecting rollers 31 and 32 and an intermediate deflecting roller 33. This roller triplet (rollers 31-33) is located stationarily close to one side of mounting frame 26. Intermediate deflecting roller 33 has a drive of its own and is in close proximity to deflecting roller 22 over which transport belt 8 passes on its path to supply arm 3.

The section of second transport belt 9 returning from supply arm 3 extends from tensioning roller 24 over deflecting roller 29 supported in mounting frame 26 and wraps deflecting roller 29 by about 180°, at which point transport belt 9 extends to a stationary deflecting roller 34 and to a take-up site A of web buffering apparatus 2 contiguous to a driven deflecting roller 35. At this point, transport belt 9 extends to a stationarily mounted deflecting roller 36 located close to pressure belt 30. At deflecting roller 36, the path of transport belt 9 extends in parallel to pressure belt 30 over deflecting roller 28 supported in mounting frame 26 and to lateral deflecting roller 31 of the roller triplet. Transport belt 9 wraps lateral deflecting roller 31 by about 90°, at which point transport belt 9 extends to roller 22 deflecting transport belt 8. Thus transport belts 8 and 9 join one another and move in parallel on their paths along arms 3 and 4 to lower end 4L of layering arm 4. In the region between deflection 36 and 31 where pressure belt 30 and second transport belt 9 are guided in parallel, belts 8 and 9 form a U-shaped path, the length of which can be varied by moving mounting frame 26 in the direction of the double arrow P.

Since deflecting rollers 28 and 29, over which transport belt 9 passes within web buffering apparatus 2, are supported by single mounting frame 26, and since transport belt 9 is routed on its path to and from deflecting rollers 28 and 29 through U-shaped paths, the length of the path between deflecting rollers 36 and 31 can vary without transport belt 9 being drawn or upset as the demand of transport belt 9 in this portion of the path is compensated by the opposite demand in the other portion of the path extending to and from deflecting roller 29.

A non-woven fiber web (not shown) supplied to take-up site A is continuously supported between two belts from its introduction into web buffering apparatus 2 in the region of driving roller 35 deflecting transport belt 9, until the discharge of the fiber web at lower end 4L of laying arm 4. Within web buffering apparatus 2, the fiber web is held between transport belt 9 and pressure belt 30 until reaching intermediate deflecting roller 33 of the roller triplet (rollers 31-33). Starting from roller 22 deflecting first transport belt 8, the fiber web is sandwiched between transport belts 9 and 8. Only at infeed zone E of cross lapper 1 within the very short portion between intermediate deflecting roller 33 of the roller triplet and deflecting roller 22 of transport belt 8 is the fiber web supported on only one side by transport belt 9. However, this region is sufficiently short that the fiber web is not damaged. Furthermore, due to the pressure on the web when supported by transport belt 9, the fiber web sticks sufficiently to transport belt 9 to provide some protection to the fiber web.

One object of web buffering apparatus 2 is to decouple the variation of the conveying speed of transport belts 8 and 9, which is matched to the varying laying movement of laying arm 4 from the constant supply speed with which the non-woven fiber web is supplied by, for example, a carding machine. The fiber web discharge of laying arm 4 must be reduced when lower end 4L of laying arm 4 approaches regions of motion reversal at the margins of output conveyor 7, since the motion of laying arm 4 must be decelerated near such margins. If laying arm 4 were to discharge the fiber web with constant speed, thickening within the fleece formed on output conveyor 7 would occur at the margins of the fleece. The formation of such thickening regions is prevented by the variation of the conveying speed of transport belts 8 and 9 as a function of the laying movement of laying arm 4.

To enable the decoupling of speeds in the path of transport belt 9 upstream and downstream of web buffering apparatus 2, two driven deflecting rollers, namely deflecting rollers 23 and 35, are provided. Rollers 23 and 35 have circumferential speeds which are decoupled from one another. Provided that the fiber web is supplied from a carding machine (not shown) with constant speed to take-up site A, the driven deflecting roller 35 at take-up site A operates with constant circumferential speed. However, the circumferential speed of the deflecting roller 23 located on the other side of web buffering apparatus 2, and conjointly therewith the circumferential speed of deflecting roller 21 deflecting transport belt 8, are controlled as a function of the laying movement of laying arm 4. If the speed of the laying movement of laying arm 4 decreases, the circumferential speed of driven rollers 23 and 21 must be decreased as well. However, as driven deflecting roller 35 continues to rotate with constant speed, the length of a U-shaped deviation loop 82 of transport belt 9 which is formed by deflecting roller 29 supported at mounting frame 26 must be decreased. At the same time, the length of a U-shaped deviation loop which is formed by web buffering apparatus 2 by deflecting roller 28 increases under the corresponding movement of mounting frame 26, so that the web buffering volume within web buffering apparatus 2 is increased. A correspondingly-decreased amount of fiber web is discharged from web buffering apparatus 2. When the movement of laying arm 4 is accelerated, the aforementioned process is performed in the reverse direction.

Additionally, web buffering apparatus 2 can be utilized to compensate for variations in the speed with which the non-woven fiber web is supplied to take-up site A. Such variations in the web supply speed are existent if a drawing unit (not shown) is disposed between a constantly working web generator, e.g. a carding machine, and cross lapper 1. The drawing unit cyclically draws the web to produce thinning therein. Such thinned web portions are layered at the margins of output conveyor 7 to produce a profile within the fleece formed on output conveyor 7. In this case, it is preferred to provide a driving means (not shown) for mounting frame 26 of web buffering apparatus 2 to positively increase and decrease the buffering volume in a controlled manner. By means of a suitable control program controlling the displacement of mounting frame 26 within web buffering apparatus 2 and also controlling driven deflecting rollers 21, 23 and 35, web buffering apparatus 2 is able to compensate for the movement of laying arm 4 and the variations of the web discharge speed of the drawing unit.

Whereas FIG. 1 shows cross arms 3 and 4 of cross lapper 1 in retracted positions, FIG. 2 shows arms 3 and 4 in extended positions. The extension of arms 3 and 4 result in a variation of the looping angles of transport belts 8 and 9 at the deflecting rollers situated at the hinges of the arms. Some of these variations compensate one another, however, and for some other of these variations, there is no automatic compensation. The necessary balance is created by tensioning rollers 19 and 24 located in the running paths of transport belts 8 and 9 and by adapted rollers 19 and 24 to comply with the tension existent in their respective transport belts. A detailed explanation of this situation is presented with reference to the embodiment illustrated in FIGS. 3 and 4, the teaching of which is also applicable in the first embodiment shown in FIGS. 1 and 2.

A second embodiment of the invention is described with reference to FIGS. 3 and 4. Elements which are similar to or the same as those of the first embodiment are provided with the same reference numerals.

Figure 3:
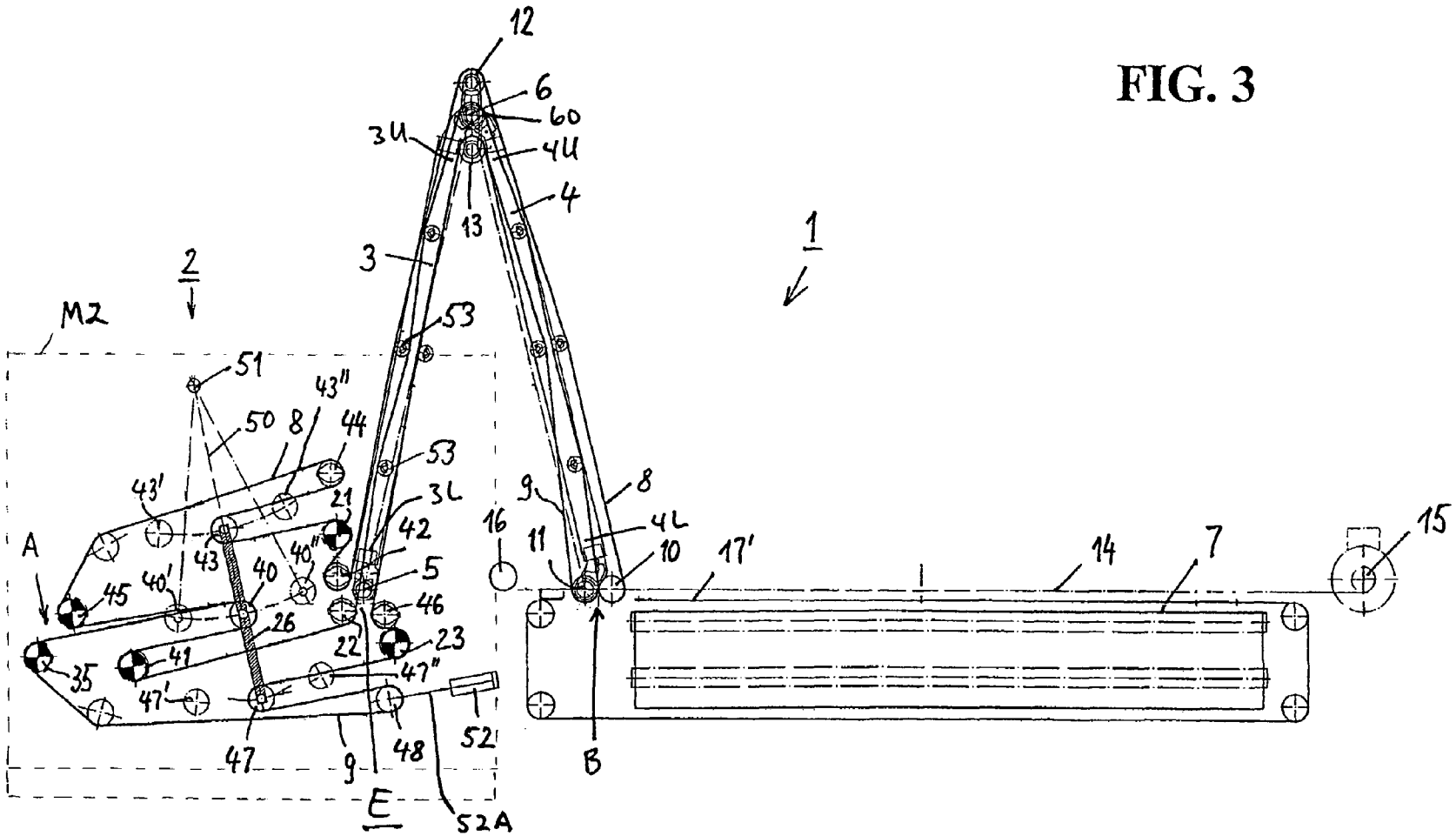
FIGS. 3 and 4 show a second embodiment of the invention in two different positions of the arms of a cross lapper of the camel back type, with a mounting frame which is adjustable in transverse direction within the web buffering apparatus.

FIG. 3 shows cross lapper 1 having supply arm 3 and laying arm 4 which are pivotably connected with one another and are mounted as in the embodiment of FIG. 1. Laying arm 4 is movably guided above output conveyor 7 by means of a toothed belt drive system 14, 15 and 16. A cover belt 17' is connected to lower end 4L of laying arm 4. Cover belt 17' is guided by way of a plurality of deflecting rollers and extends over output conveyor 7 transversely thereto to avoid air turbulence that may be caused by the movement of laying arm 4 from affecting the fleece formed on output conveyor 7.

A variable-volume fiber web buffering apparatus 2 is located to the left side of cross lapper 1. Web buffering apparatus 2 comprises transport belts 8 and 9, each of which run through web buffering apparatus 2 and also along arms 3 and 4 of camel back cross lapper 1.

Transport belts 8 and 9 together define a take-up site A at which a non-woven fiber web (not shown) from a fiber web generator (also not shown) to be processed by cross lapper 1 is supplied into a gap between transport belts 8 and 9. Starting from take-up site A, transport belts 8 and 9 move as a pair over a deflecting roller 40, a driving roller 41, another deflecting roller 22 to the infeed zone B of the cross lapper 1, and along arms 3 and 4 of the cross lapper 1, in which transport belts 8 and 9 are guided over a deflecting roller 60 located at a hinge 6 of arms 3 and 4. At this point, transport belts 8 and 9 extend to two deflecting rollers 10 and 11 at lower end 4L of laying arm 4, where they are separated from one another to be returned independently via arms 4 and 3 of the cross lapper 1 to the take-up site A. Deflecting rollers 10 and 11 together define a web discharge site B at which the web supplied from cross lapper 1 by the pivotal movements of the arms 3 and 4 is layered by laying arm 4 onto output conveyor 7.

On their return path from web discharge site B to take-up site A, transport belt 8 runs over deflecting roller 12 situated in the region of hinge 6 of arms 3 and 4. After leaving supply arm 3, transport belt 8 runs over another deflecting roller 42 and a driving roller 21. At this point, belt 8 moves in an essentially U-shaped path the apex of which is formed by a deflecting roller 43, to another deflecting roller 44 and another driving roller 45, positioned by the take-up site A.

Transport belt 9 extends from web discharge site B over deflecting roller 13 situated in the region of hinge 6, and after leaving the supply arm 3, over a deflecting roller 46, a driving roller 23, a U-shaped path the apex of which is formed by a deflecting roller 47, a deflecting tensioning roller 48 and a driving roller 35, situated close to take-up site A.

Deflecting rollers 43 and 47, situated in said apexes of the U-shaped paths of the returning sections of transport belts 8 and 9, are rotatably supported in a mounting frame 26 on which deflecting roller 40 is mounted. Transport belts 8 and 9 jointly pass over deflecting roller 40. Mounting frame 26 is mounted at a frame-like link 50 in a manner such that it may be pivoted around the axis of said first deflecting roller 40. Said link 50 is shown in the drawing by phantom lines only and is in turn pivotably mounted like a pendulum in pivot bearing 51 mounted in a machine stand M2 (shown in dotted line format only in FIG. 3).

Deflecting tensioning roller 48 is mounted to a tensioning arm 52A of a hydraulic cylinder 52. The tensioning force acting at tensioning roller 48 and created by hydraulic cylinder 52 biases transport belt 9. The tensioning force is transferred via deflecting roller 47 and mounting frame 26, acting as a double-armed lever and pivoting around the axis of deflecting roller 40, and via deflecting roller 43 onto the returning section of transport belt 8. Thus, by means of single hydraulic cylinder 52, both transport belts 8 and 9 can be tensioned.

On their paths over arms 3 and 4, transport belts 8 and 9 run over a plurality of guiding rollers 53 mounted on arms 3 and 4, the guiding rollers 53 alternatingly contacting one and the other sides of transport belts 8 and 9 guided as a pair over arms 3 and 4. Guiding rollers 53 serve to avoid flopping movement of belts 8 and 9, a function also realized within the first embodiment of the invention.

In the following, some operational conditions are taken into consideration and explained in the following paragraphs.

As long as driving rollers 21, 23, 35, 41 and 45 have equal circumferential speeds, mounting frame 26 remains in its position as shown in FIG. 1. When the circumferential speed of driving roller 41 is increased with respect to the circumferential speeds of the other driving rolls, driving roller 41 draws mounting frame 26 to the left in FIG. 3 through paired transport belts 8 and 9 and deflecting roller 40, decreasing the lengths of the transport belt portions which sandwich a fiber web between one another. At the same time, the lengths of the returning sections of transport belts 8 and 9 are increased, since deflecting rollers 43 and 47 supported by mounting frame 26 are moved to the left. Deflecting rollers 43 and 47 form the apex of U-shaped path sections increased by the movement of mounting frame 26. The locations of the deflecting rollers supported at mounting frame 26 and moved to the left are shown in FIGS. 3 and 4 by 40', 43' and 47', respectively. If, however, the driving speed of driven roller 41 is decreased with respect to the driving speeds of the other driven rolls, mounting frame 26 moves to the right in FIG. 3 so that deflecting rollers 40, 41, and 47 supported by mounting frame 26 are moved to the right into the positions shown by 40", 43" and 47", respectively. As the displacement of deflecting rollers 40, 43 and 47 is effected in equal amounts, the tension of transport belts 8 and 9 is maintained.

The length portions of transport belts 8 and 9 between take-up site A and web discharge site B may be varied by the lateral movement of mounting frame 26. Thus, it is possible to temporarily change the speed of the web discharge at web discharge site B with respect to the speed at which the web is taken in at take-up site A. This variation of speeds is necessary in the cross lapper 1 because the speed with which web discharge site B, i.e. lower end 4L of laying arm 4, moves over the output conveyor 7 must not be held constant, as already explained. The necessary variation of the discharge speed of the fiber web from the nip between belts 8 and 9 at deflecting rollers 10 and 11 may be attained by suitable control of the speed of driven rollers 41, 21 and 23 with respect to the speed of driven rollers 35 and 45. Thus, mounting frame 26 performs a pendulum movement about bearing 51, by which deflecting rollers 40, 43 and 47 are moved between locations 40', 43' and 47' on one end and locations 40", 43" and 47" on the other end, cyclically varying the web volume buffered in web buffering apparatus 2.

Figure 4:
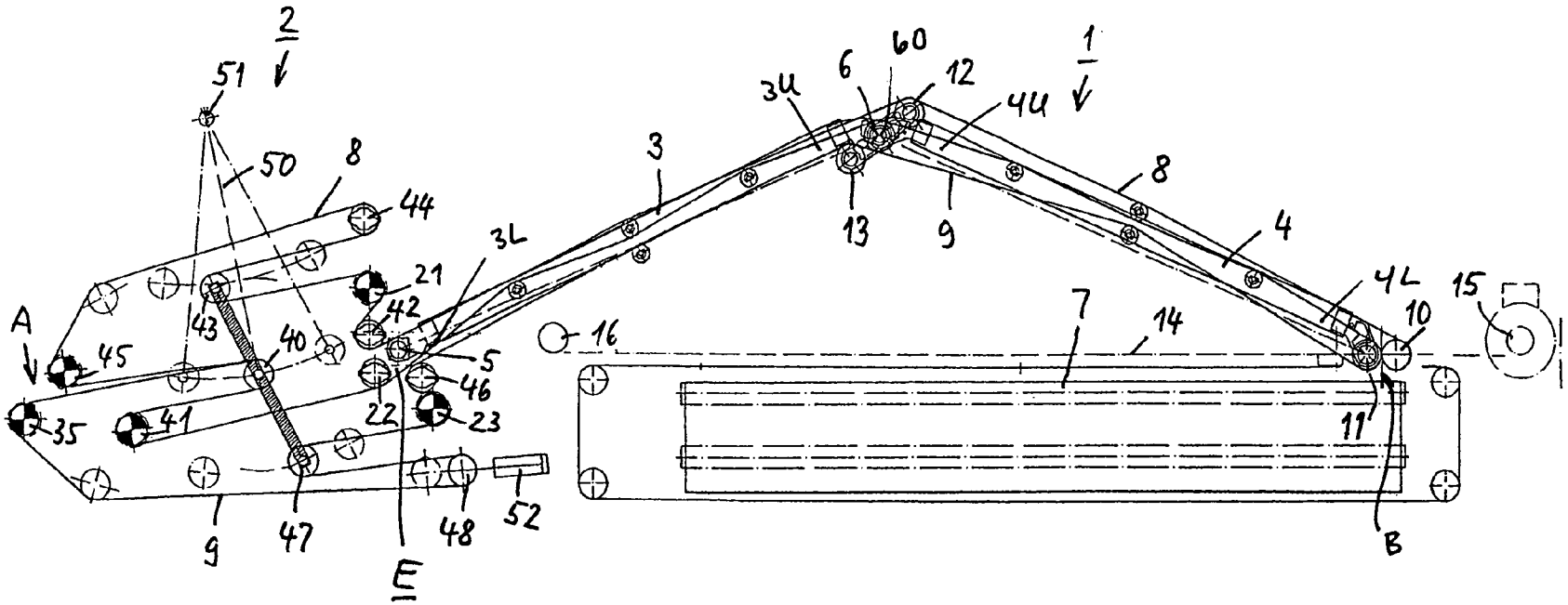

A further movement of frame 26 is now explained using FIGS. 3 and 4. FIG. 4 shows cross lapper 1 in an extended position of supply arm 3 and laying arm 4. It can readily be seen in FIG. 4 that the looping angles of transport belts 8 and 9 at deflecting roller 60 at hinge 6, at deflecting rollers 12 and 13 located in the region of hinge 6 of arms 3 and 4, and at deflecting rollers 22, 24 and 26 located close to a lower pivot bearing 5 of supply arm 3, are different from the position shown in FIG. 3. While the change of the looping angles of the transport belts when paired and also the change of the looping angles at deflecting rollers 12 and 13 located near hinge 6 and passed by the returning sections of transport belts 8 and 9, do not have influence on transport belts 8 and 9 in an opposed sense, the looping angle of the returning section of transport belt 8 at deflecting roller 42 in FIG. 4 is smaller than that of FIG. 3. However, the looping angle of the returning section of second transport belt 9 at deflecting roller 46 is larger than that in FIG. 3. Thus, the looping angles of transport belts 8 and 9 at deflecting rollers 42 and 46, respectively, vary in opposite senses. In its returning section, transport belt 8 requires an increase in the length of its running path, whereas in the returning section of transport belt 9, the length of its running path decreases. Both of these changes can be attained by tensioning roller 48 under the influence of hydraulic cylinder 52, drawing tensioning roller 48 to the right, so that mounting frame 26 is pivoted at link 50 in a counter-clockwise fashion from its position shown in FIG. 3 into the position shown in FIG. 4. The length of the returning section of transport belt 9 is decreased, and at the same time, the length of the returning section of first transport belt 8 is increased.

The movements of mounting frame 26 at pivot bearing 51 of link 50 and the pivotal movements of mounting frame 26 at link 50 around the axis of deflecting roller 40 jointly deflecting paired transport belts 8 and 9 combine in operation, since the compensation of the speed difference of transport belts 8 and 9 at web discharge site B and at the take-up site A and the compensation of the opposite variations of the roller looping angles must be performed simultaneously. As shown in FIGS. 3 and 4, both effects can be attained by means of a very simple arrangement which is particularly suitable to be used in camel back cross lappers.

As an example for the embodiment of FIGS. 3 and 4, the laying width can be 3.500 mm. The length of the arms 3 and 4 between deflecting roller 16 and the ends of the arms is 2.800 mm each. Transport belts 8 and 9 each have a length of 21.500 mm. The movement path of camel back cross lapper 1 is 4.000 mm. In the retracted position of arms 3 and 4 as shown in FIG. 3, arms 3 and 4 form an angle of about 27°, whereas in the extended position shown in FIG. 4, arms 3 and 4 form an angle of about 133°. The imbalance of the yielding of transport belts 8 and 9 caused by the different arm positions and by the change of the looping angles at deflecting rollers 42 and 46 following therefrom, is compensated by a displacement of tensioning roller 41 by about 200 mm by hydraulic cylinder 52. Frame-like link 50 at which the mounting frame 26 is suspended has an effective length (pendulum length) of 1.400 mm, whereas deflecting rollers 43 and 47 supported at mounting frame 26 have a distance to deflecting roller 40 jointly wrapped by transport belts 8 and 9 of 520 mm each. The space occupied by web buffering apparatus 2 has a length of 2.100 mm in front of camel back cross lapper 1 and a height of 1.750 mm, including link 50.

Various modifications may be made to the apparatus shown in the figures and explained herein, and such modifications are obvious to one skilled in the art. Deflecting roller 50 supported at mounting frame 26 may be a driven roll, while roller 41 may be an idling deflecting roller. Further, deflecting rollers 43 and 47 supported at mounting frame 26 may be driven rolls, while rollers 21 and 23 may be idling rolls. Instead of being mounted at link 50, mounting frame 26 may be pivotably supported by an adjustable carriage. Further, cross lapper 1 may be provided with four arms pivotably connected to one another to attain a larger laying width without increasing the height of cross lapper 1. Transport belts 8 and 9 would then be guided along all four arms so that the fiber web is sandwiched between two transport belts along its entire path from take-up site A to web discharge site B.

While the principles of the invention have been shown and described in connection with specific embodiments, it is to be understood that such embodiments are by way of example and are not limiting.

The invention claimed is:

1. A fleece laying apparatus comprising:

a camel back cross lapper having (a) an infeed zone, (b) an output conveyor, (c) a supply arm, (d) a laying arm with a lower end reciprocatingly guided on a path above the output conveyor and transverse to an output direction of the output conveyor, and (e) two delivery transport belts guided in juxtaposed fashion from the infeed zone to the laying-arm lower end; and variable-volume web buffering apparatus upstream of the infeed zone and adapted to hold a web between two take-up transport belts at least one of which is one of the two delivery transport belts, the web buffering apparatus including:

a movable common frame; and frame rollers rotatably mounted on the common frame, the frame rollers including a two-belt roller deflecting the take-up transport belts by about 180°, and at least two one-belt rollers, the common frame movable transverse the roller axes, at least one of the one-belt rollers wrapped by the one delivery transport belt, such belt guided through an upstream web take-up site to the infeed zone, whereby the web is sandwiched between paired belts for substantially the entire path from the take-up site to the output conveyor.

2. The fleece laying apparatus of claim 1 further comprising:

a triplet of stationary rollers including two lateral triplet rollers close to the common frame and an intermediate triplet roller between the lateral rollers;

a fourth stationary roller closely opposing the intermediate triplet roller and partially wrapped by the other of the two delivery transport belts; and a fifth stationary roller, wherein (a) the common frame is movable within a plane defined by axes of the frame rollers; (b) the other of the two take-up transport belts is a pressure belt adjacent to the fifth stationary roller, the pressure belt passing over two of the frame rollers adjacently mounted on the common frame and wrapping the two lateral triplet rollers by about 90° and the intermediate triplet roller by about 180°; (c) the portion of the delivery/take-up transport belt that returns from the supply arm passes over another of the one-belt rollers on the common frame, wrapping such one-belt roller by about 180°, passing to the take-up site and downstream over the fifth stationary roller; and (d) the delivery/take-up belt is guided from the take-up site in a manner juxtaposed with the pressure belt to wrap the two-belt roller by about 180°, then to wrap one of the lateral triplet rollers by about 90°, and from there past the intermediate triplet roller to the fourth stationary roller, there joining the other of the two delivery transport belts running to the supply arm.

3. The fleece laying apparatus of claim 2 wherein the intermediate triplet roller is a driven roll.

4. The fleece laying apparatus of claim 1 further including a drive system, the drive system being coupled to move the common frame.

5. The fleece laying apparatus of claim 2 further including:

two tensioning rollers each wrapped by about 180° by a respective one of the two delivery transport belts; and tension sources moving the tensioning rollers.

6. The fleece laying apparatus of claim 1 wherein the juxtaposed delivery transport belts between the infeed zone and the layering-arm lower end are jointly guided along the supply and layering arms via a plurality of guiding rollers disposed seriatim along the arms, adjacent guiding rollers engaging opposite sides of the juxtaposed belts.

7. The fleece laying apparatus of claim 1 wherein both of the two take-up transport belts are the two delivery transport belts.

8. The fleece laying apparatus of claim 7 wherein:

the delivery transport belts run in juxtaposed fashion from a U-shaped feed path portion around the two-belt frame roller of the web buffering apparatus all the way to the laying-arm lower end;

separate portions of the delivery transport belts return from the laying-arm lower end to the take-up site through U-shaped return path portions each around a respective one of the one-belt frame rollers, each of such U-shaped return path portions being oriented opposite to the U-shaped feed path portion; and the common frame which carries the three frame rollers is movably mounted in a machine stand, movable substantially parallel to the path portions extending to and from the frame deflecting rollers, thereby varying the buffering volume of the web buffering apparatus.

9. The fleece laying apparatus of claim 8 wherein the common frame is pivotably supported around the axis of the two-belt frame roller.

10. The fleece laying apparatus of claim 8 wherein the common frame is movably held by a pendulum.

11. The fleece laying apparatus of claim 10 wherein the common frame is pivotably supported around the axis of the two-belt frame roller.

12. The fleece laying apparatus of claim 8 further including a tensioning roller movably mounted to the machine stand, the delivery transport belt from one of the U-shaped return path portions substantially half-wrapping the tensioning roller, the tensioning roller being biased away from the U-shape of such return path portion.

13. The fleece laying apparatus of claim 8 further including first and second independent drive rollers and a common drive roller, wherein the separate portions of the delivery transport belts are each guided over a respective one of the independent drive rollers and the juxtaposed portions of the delivery transport belts are commonly guided over the common drive roller, the common drive roller being driven at a circumferential speed that is variable with respect to the circumferential speeds of the first and second independent drive rollers, whereby the discharge speed of the apparatus is varied with respect to the take-up speed of the apparatus.

14. The fleece laying apparatus of claim 8 further including first and second independent drive rollers, wherein the delivery transport belts are each guided over a respective one of the independent drive rollers and the two-belt frame roller is also a driven roller, the two-belt frame roller being driven at a circumferential speed that is variable with respect to the circumferential speeds of the first and second independent drive rollers, whereby the discharge speed of the apparatus is varied with respect to the take-up speed of the apparatus.

* * * * *

UNITED STATES PATENT AND TRADEMARK OFFICE

CERTIFICATE OF CORRECTION

PATENT NO. : 7,320,154 B2
APPLICATION NO. : 11/074891
DATED : January 22, 2008
INVENTOR(S) : Joachim Leger It is certified that error appears in the above-identified patent and that said Letters Patent is hereby corrected as shown below:

In column 7, line 62, delete “the infeed zone B” and insert --the infeed zone E--.

Signed and Sealed this

First Day of July, 2008

JON W. DUDAS
*Director of the United States Patent and Trademark Office*